United States Patent [19]
Lofquist

[11] 4,325,397
[45] Apr. 20, 1982

[54] METHOD TO REDUCE PRESSURE DROP IN POLYAMIDE PROCESS PIPING

[75] Inventor: Robert A. Lofquist, Richmond, Va.

[73] Assignee: Allied Chemical Corporation, Morris Township, Morris County, N.J.

[21] Appl. No.: 178,319

[22] Filed: Aug. 15, 1980

[51] Int. Cl.[3] ..... F17D 1/16
[52] U.S. Cl. ..... 137/13
[58] Field of Search ..... 137/13

[56] References Cited

U.S. PATENT DOCUMENTS

| | | | |
|---|---|---|---|
| 459,374 | 5/1904 | Issacs et al. | 137/13 |
| 2,821,205 | 1/1928 | Chilton et al. | 137/13 |
| 3,040,760 | 6/1962 | Macks | 137/13 |
| 4,181,137 | 1/1980 | Conti | 137/13 |

OTHER PUBLICATIONS

Canadian Journal of Engineering; Feb. 1961; pp. 27–36; Article by Charles, Grovier & Hodgson.
A.I.Ch.E. Journal; vol. 10, No. 6, pp. 817–819, Nov. 1964; Article by J. C. Slattery.

*Primary Examiner*—Alan Cohan
*Attorney, Agent, or Firm*—Richard A. Anderson

[57] ABSTRACT

This invention is a method to reduce pressure drop in polyamide process piping comprising injecting linear polyethylene glycol having a molecular weight above 10,000 around the periphery of the piping and forming a coating of the polyethylene glycol on the internal surface of the piping where it lubricates the flowing polyamide.

3 Claims, No Drawings

METHOD TO REDUCE PRESSURE DROP IN POLYAMIDE PROCESS PIPING

BACKGROUND OF THE INVENTION

This invention relates to a method to reduce pressure drop of viscous materials flowing through pipes. More particularly, it relates to a method to reduce pressure drop in polyamide process piping.

By polyamide is meant nylon, particularly long chain polymeric amides having recurring amide linkages as an integral part of the polymer chain, and capable of being formed into a shaped structure such as a filament, film, or engineering plasticstype structure. Examples are nylon 6, nylon 6,6, nylon 4, nylon 6,10, and the like and blends thereof.

Attempts to reduce the pressure drop of viscous material flowing through pipes are not new. For instance, in 1904, Isaacs & Speed received a patent for conveying oil through an envelope of water, U.S. Pat. No. 759,374. In 1961, Charles, Govier, and Hodgson reported "The Horizontal Pipe Line Flow of Equal Density Oil-Water Mixtures". In 1964, J. C. Slattery did a theoretical analysis of "Two-Phase Annular Laminar Flow of Simple Fluids Through Cylindrical Tubes".

In U.S. Pat. No. 2,821,205 to Chilton et al., a method and apparatus for lubricating pipe lines is disclosed, primarily directed to use of water in oil pipe lines.

U.S. Pat. No. 3,040,760 to Macks describes a conduit having a foraminous liner which distributes high pressure gas in a thin layer on the internal surface of process piping to improve flow of viscous material.

The two above U.S. patents are both hereby incorporated by reference, in toto. The Macks invention is very complex and expensive and, therefore, not practical. In the processing of polyamides, the problems of reducing pressure drop through the process piping is complicated by the fact that the viscous polymer is very hot, and many materials are dissolved, destroyed, or miscible with the polymer. There has been no report of any work on viscous polymers at high temperature to reduce the pressure drop in the process piping.

SUMMARY

This invention of reducing pressure drop has the following advantages:

(1) reduction of pressure drop in long lines, thereby saving the energy necessary to overcome the pressure drop, (2) reduction of hold up times by allowing smaller pipe sizes, and (3) eliminating regions of stagnant polymer and channeling through a flattening of the flow profile.

These last two advantages overcome the polymer degradation problem due to long hold up and stagnant polymer pockets.

The technique of this invention is a method to reduce pressure drop in polyamide process piping comprising injecting linear polyethylene glycol having a molecular weight above 10,000 around the periphery of the piping and forming a coating of polyethylene glycol on the internal surface of the piping where it lubricates the flowing polyamide. The preferred rate of injection is from about 1 to about 20 percent by weight of the polyamide flowing, of polyethylene glycol injected. Even more preferred is the rate of from about 1.5 to 4 percent, by weight of the polyamide flow.

Pressure drop through the process piping can be lowered by a factor of about fifty times in demonstrations.

DESCRIPTION OF THE PREFERRED EMBODIMENT

EXAMPLE 1

An acid terminated nylon 6 polymer having a viscosity in formic acid of about 50 was pumped at 5.3 (2.4 kg/hr) pounds per hour through a 0.305 inch (0.775 cm) internal diameter tubing 20 feet (6.17 meters) long at 60° C. At the same time, 2.5 grams per minute of Carbowax 20,000 linear of Union Carbide polyethylene glycol, was injected into the tube creating a film of the injected material between the inner wall of the tube and the stream of molten polymer. The injection was through ports around the periphery of the tubing as shown in FIG. 5 of U.S. Pat. No. 2,821,205, incorporated by reference above. The circumferential row of holes consisted of eight holes spaced at 45-degree intervals around the pipe. The pressure drop from the point of injection to the end of the 20-foot (6.17 meters) length of tubing was 40 psig (2.8 kg/cm$^2$). Then the rate of injecting the Carbowax 20,000 was reduced to 1.05 grams per miniute and the pressure at the point of injection rose to a steady 55 psig (3.87 kg/cm$^2$) after about 25 minutes. The rate of injection was decreased to 0.528 gram per minute and held at this rate for 20 minutes. The pressure rose to a steady 100 psig (7.03 kg/cm$^2$). Injection of Carbowax 20,000 was stopped and the pressure rose after about 20 minutes to 2,000 psig (140 kg/cm$^2$) at the point of injection. This pressure drop remained steady for 10 minutes at which time the flow of nylon was stopped.

EXAMPLE 2

An acid terminated nylon 6 polymer of about 50 formic acid viscosity was pumped at a rate of 4 pounds (1.8 kg) per hour at 250° C. through a 0.27-inch (0.68 cm) internal diameter tube 20 feet (6.17 meters) long. The method of injection was as in Example 1. Simultaneously, 3 grams per minute of Carbowax 20,000 linear was injected into the tube forming a film between the polymer and the walls of the tubing. The pressure drop from the point of injection to the polymer outlet was 100 psig (7.0 kg/cm$^2$). The rate of injection was reduced to 2 grams per minute and the pressure drop at the point of injection rose over a 10-minute period to about 150 psig (10.5 kg/cm$^2$). The pressure drop remained constant for another 10 minutes. The rate of injection was reduced to 1.2 grams per minute. The pressure at the point of injection rose to 375 psig (26.4 kg/cm$^2$) and remained steady. Then the rate of injection was decreased to about 0.9 gram per minute of Carbowax 20,000. The pressure at the point of injection rose rapidly to over 1,000 psig (70 kg/cm$^2$). The pump used to inject the Carbowax 20,000 was unable to overcome this pressure and the flow of nylon was stopped.

The high molecular weight polyethylene glycol is the only compound found in a study which would stay as an annular film on the interior surface of the piping. It has a density almost equal to the polyamides, is immiscible, and preferentially wets the wall of the pipe. The successful candidate also has the following characteristics:

(1) It was unreactive with polyamide.

(2) It was thermally stable.

(3) It did not affect the dyeability, dye light fastness, light strength flammability or other characteristics of the polyamide.

(4) It is nonvolatile.

(5) It has the correct viscosity.

(6) It was nontoxic.

(7) It had a high flash point.

(8) It was not expensive.

I claim:

1. A method to reduce pressure drop in polyamide process piping comprising injecting a fluid consisting essentially of linear polyethylene glycol having a molecular weight above 10,000 around the periphery of the piping and forming a coating of the polyethylene glycol on the internal surface of the piping where it lubricates the flowing polyamide.

2. The method of claim 1 wherein from about 1 to about 20 percent, by weight of the polyamide flowing, of polyethylene glycol is injected.

3. The method of claim 1 wherein from about 1.5 to 4 percent, by weight of the polyamide flowing, of polyethylene glycol is injected.

* * * * *